US005937257A

United States Patent [19]

Condello et al.

[11] Patent Number: 5,937,257

[45] Date of Patent: Aug. 10, 1999

[54] RETRACTABLE OIL REDUCING METERING BLADE

[75] Inventors: Anthony S. Condello, Webster; Robert M. Jacobs, Ontario, both of N.Y.

[73] Assignee: Xerox Corporation, Stamford, Conn.

[21] Appl. No.: 09/004,764

[22] Filed: Jan. 8, 1998

[51] Int. Cl.[6] ..... G03G 15/20

[52] U.S. Cl. ..... 399/325; 399/320; 399/324; 399/326

[58] Field of Search ..... 399/320, 324, 399/325, 326; 118/DIG. 1

[56] References Cited

U.S. PATENT DOCUMENTS

| | | | |
|---|---|---|---|
| 4,214,549 | 7/1980 | Moser | 118/60 |
| 5,132,739 | 7/1992 | Mauer et al. | 399/325 |
| 5,212,527 | 5/1993 | Fromm et al. | 355/284 |
| 5,221,948 | 6/1993 | Dalal | 399/325 |
| 5,406,363 | 4/1995 | Siegel et al. | 399/325 |
| 5,504,566 | 4/1996 | Chow et al. | 399/325 |
| 5,625,859 | 4/1997 | Moser | 399/325 |

OTHER PUBLICATIONS

Xerox Disclosure Journel, vol. 3, No. 6, Nov./Dec. 1978—Release Agent Metering Device.

*Primary Examiner*—Richard Moses
*Assistant Examiner*—Shival Virmani
*Attorney, Agent, or Firm*—Benjamin B. Sklar; Robert A. Chittum

[57] ABSTRACT

A Release Agent Management (RAM) system for a heat and pressure fuser apparatus utilized for fixing color toner images on substrates such as plain paper and transparency material such as Mylar™. A donor/metering roll arrangement is provided with two oil metering blades, one of which is operative during two modes of operation and the other of which is operative during only one of the two modes of operation. During one mode of operation when color toner images are formed on a substrate such as plain paper, only one of the two blades is utilized. During a second mode of operation when color toner images are created on a transparent substrate such as Mylar™, both blades engage the surface of the metering roll so that a lesser amount of oil is ultimately conveyed to the surface of the heated fuser roll.

17 Claims, 2 Drawing Sheets

RETRACTABLE OIL REDUCING METERING BLADE

BACKGROUND OF THE INVENTION

This invention relates generally to heat and pressure fusers for fixing color images an electrophotographic printing machines, and more particularly to a Release Agent Management (RAM) therefor.

In a typical electrophotographic printing process, a photoconductive member is charged to a substantially uniform potential so as to sensitize the surface thereof. The charged portion of the photoconductive member is exposed to selectively dissipate the charges thereon in the irradiated areas. This records an electrostatic latent image on the photoconductive member. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules either to a donor roll or to a latent image on the photoconductive member. The toner attracted to a donor roll is then deposited on a latent electrostatic images on a charge retentive surface which is usually a photoreceptor. The toner powder image is then transferred from the photoconductive member to a copy substrate. The toner particles are heated to permanently affix the powder image to the copy substrate.

In order to fix or fuse the toner material onto a support member permanently by heat, it is necessary to elevate the temperature of the toner material to a point at which constituents of the toner material coalesce and become tacky. This action causes the toner to flow to some extent onto the fibers or pores of the support members or otherwise upon the surfaces thereof. Thereafter, as the toner material cools, solidification of the toner material occurs causing the toner material to be bonded firmly to the support member.

One approach to thermal fusing of toner material images onto the supporting substrate has been to pass the substrate with the unfused toner images thereon between a pair of opposed roller members at least one of which is internally heated. During operation of a fusing system of this type, the support member to which the toner images are electrostatically adhered is moved through the nip formed between the rolls with the toner image contacting the heated fuser roll to thereby effect heating of the toner images within the nip.

The heated fuser roll is usually the roll that contacts the toner images on a substrate such as plain paper. In any event, the roll contacting the toner images is usually provided with an abhesive material for preventing toner offset to the fuser member. Three materials which are commonly used for such purposes are PFA™, Viton™ and silicone rubber. All of these materials, in order to maintain their abhesive qualities, require release agents specific to the material.

Various methods are known for applying release agent materials to a fuser member such as a heated fuser roll. One such system comprises a Release Agent Management (RAM) system including a donor roll which contacts the fuser member to which the oil or release agent material is applied. The donor roll also contacts a metering roll which conveys the oil from a supply of oil to the donor roll. With such a system, it is customary to use a metering blade to meter the silicone oil or other suitable release agent material to a desired thickness onto a metering roll. In the fusing of monochrome (i.e. black on a conventional imaging substrate) the uniformity of the oil layer on the metering roll is not so critical compared to that required for color toner images, particularly, those associated with transparency substrate materials used for optically projecting the color images.

Following is a discussion of prior art, incorporated herein by reference, which may bear on the patentability of the present invention. In addition to possibly having some relevance to the question of patentability, these references, together with the detailed description to follow, may provide a better understanding and appreciation of the present invention.

U.S. Pat. No. 4,214,549 granted to Rabin Moser on Jul. 29, 1980 discloses a RAM system comprising a donor roll comprising an outer layer fabricated from a heat insulative and deformable material, for example, silicone rubber which transfers functional release material from a metering roll a heated fuser roll. A metering blade is supported in contact with the metering roll for metering the release material onto the metering roll to a specified amount per copy. This type of RAM system dispenses a fixed amount of release agent material to the fuser roll member.

U. S. Pat. No. 5,504,566 granted to Chow et al on Apr. 2, 1996 discloses an apparatus for fusing toner images to a substrate. A Release Agent Management (RAM) system for applying silicone oil to a metering roll utilizes a pair of metering blades to improve oil uniformity on the metering roll. Thus, streaks or localized areas of excess silicone oil as the result of blade defects and/or dirt accumulation associated with a first blade, are metered or smoothed to a more uniform thickness by the second blade. To this end, the first metering blade serves to meter silicone oil to a first predetermined thickness while the second blade serves to meter oil streaks to a second predetermined thickness which is greater than the first predetermined thickness.

U. S. Pat. No. 5,212,527 granted to Fromm et al on May 18 discloses a release agent management (RAM) system including a metering roll supported for contact with release agent material contained in a sump. A donor roll is provided for applying oil deposited thereon by the metering roll. A metering blade structure for metering silicone oil onto the metering roll has two modes of operation. In one mode, a wiping action of a metering blade meters a relatively large quantity of silicone oil to the roll surface for accommodating the fusing of color toner images. In another mode of operation, a doctoring action is effected for metering a relatively small amount of silicone oil to the roll surface for accommodating the fusing of black toner images.

U.S. Pat. No. 5,625,859 granted to Rabin Moser on Apr. 29, 1997 discloses a method and apparatus for preventing oil streaks on color transparencies. To this end release agent material in the form of silicone oil is applied to a heated fuser roll using the metering roll of a two-roll RAM system. The silicone oil applied to the fuser roll is then metered to a uniform thickness with a metering blade contacting the surface of the heated fuser roll. The blade is adapted to be engaged with the fuser roll only during the fusing of process color images on transparency material in order to minimize wear of the blade and/or fuser roll surface and to minimize contamination of the blade due to unnecessary contact.

A release agent management system is disclosed in Xerox disclosure Journal, Vol. 3, Number 6, November/December 1978. As disclosed therein, the RAM system comprises a metering roll to which silicone oil is applied or metered using a pair of blades. The metering roll is disposed such that it can be rotated through silicone oil contained in a sump. A first metering blade is supported for contact with the roll in a position below a second metering blade. The first metering blade is mounted slightly above the fluid level of the silicone oil contained in the sump. By tandem mounting the two blades less frequent maintenance is required because there is double the area for toner or dirt accumulation. By such orientation of these blades, the device is less dependent upon a tall curtain of oil, thus allowing a minimum static height which minimizes potential sloshing problems when the machine containing the device is moved about. The blade serves to pre-meter a fixed amount of oil which can subsequently be precision metered to the roll by the second blade. Thus, a first thickness of oil is metered to a lesser thickness by the second blade.

U.S. patent application Ser. No. 08/936216 filed on Sep. 26, 1997 in the name of Condello et al relates to a Release Agent Metering (RAM) system including a metering roll and a pair of metering blades. is positioned in contact with a metering roll at a location intermediate, a nip formed through pressure contact of the metering roll with a donor roll, and a supply of release agent material such that as the metering roll is rotated in the imaging process direction release agent material is metered onto the metering roll and contaminants are prevented from getting deposited on the fuser roll. A second metering blade contacts the metering roll at a location that is intermediate the aforementioned nip and the supply of release agent such that when the metering roll is rotated in the direction opposite to the process direction excess release agent material and/or contaminants are prevented from being deposited on the fuser roll.

BRIEF SUMMARY OF THE INVENTION

According to the intents and purposes of the present invention, there is provided a RAM system including a donor roll, metering roll and a pair of metering blades. The metering roll which contacts a supply of release agent material such as silicone oil conveys oil from the supply to the donor roll which, in turn, conveys the oil to the a heated fuser roll. During one mode of operation, therefore, when fixing color toner images on a transparent substrate, both of the blades are operatively engaged with the surface of the metering roll while in another mode of operation, therefore, when fixing color toner images on a substrate such as plain paper, only one of the blades is engaged. When a single blade is utilized a greater amount of oil remains on the metering roll than when both blades are utilized, the greater amount being required for fusing color toner images on substrates such as plain paper. With both blades engaging, the metering roll a lesser amount of oil remains on the metering roll which satisfies the requirement for fusing color toner images on substrates such as Mylar™ transparencies. Reduction of the oil used while fusing color toner images on a transparencies results in fewer oil streaks on the transparency as well as producing projectable images which appear brighter.

In addition to accommodating the two modes of operation, the temperature to which the blade is subjected reduced by about 100° F. when metering is effected exclusively on the metering roll. This reduced temperature enables an increased blade rigidity compared to that when a blade is used to meter oil on a heated fuser roll member. Also, by not metering oil on the heated fuser roll surface, the possibility of altering image gloss and causing damage to the fuser roll surface is eliminated.

DESCRIPTION OF THE PREFERRED EMBODIMENT(S) OF THE INVENTION

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

Figure 2:
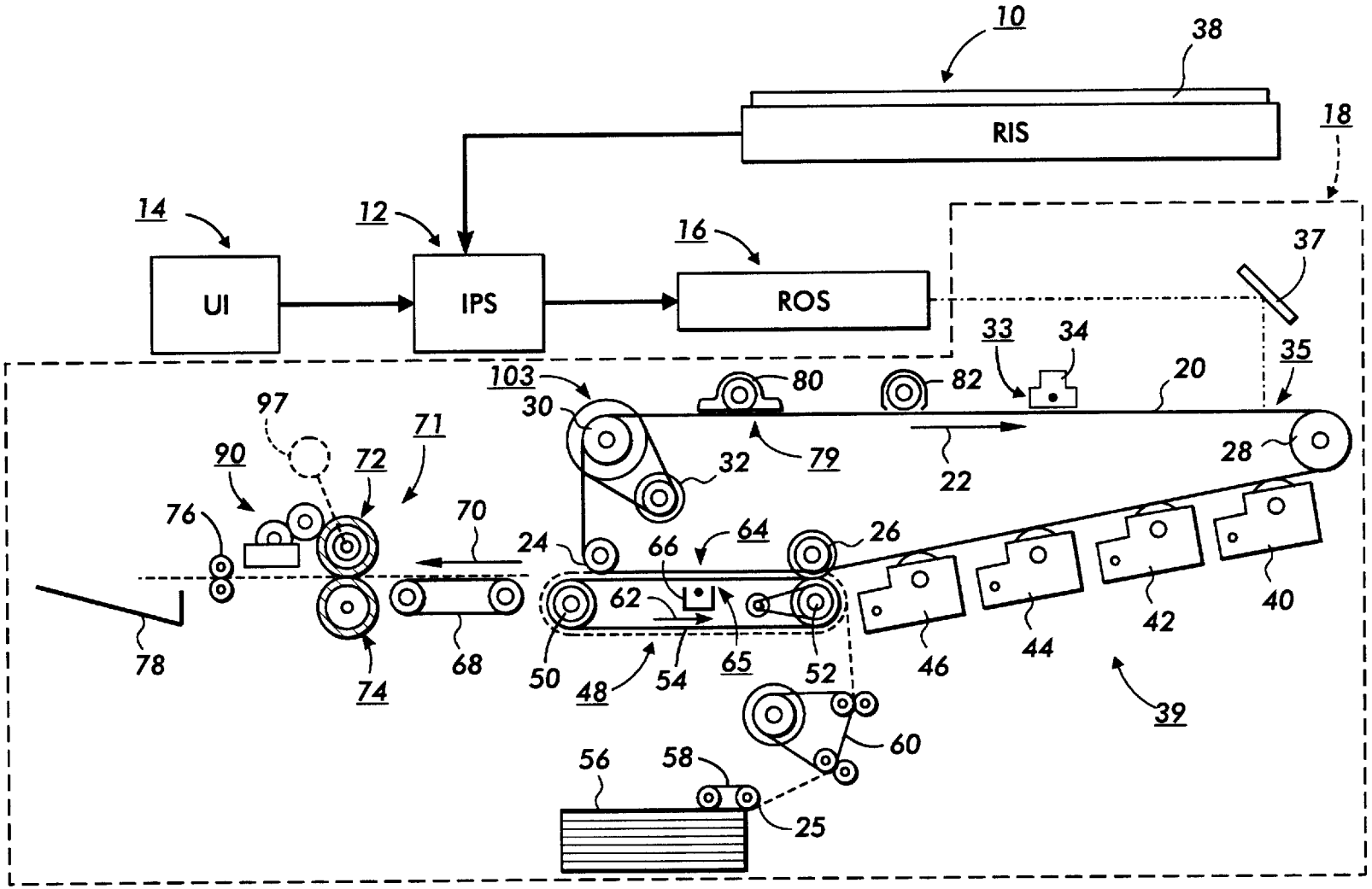
FIG. 2 is a schematic representation of a prior art xerographic imaging apparatus.

For a general understanding of the features of the present invention, reference is made to the drawings. FIG. 2 schematically depicts the various components of an illustrative electrophotographic printing machine incorporating the present invention therein. It will become evident from the following discussion that the apparatus of the present invention is equally well suited for use in a wide variety of printing machines, and is not necessarily limited in its application to the particular electrophotographic printing machine shown herein.

Turning initially to FIG. 2, during operation of the printing system, a multi-color original document 38 is positioned on a raster input scanner (RIS), indicated generally by the reference numeral 10. The RIS contains document illumination lamps, optics, a mechanical scanning drive, and a charge coupled device (CCD array). The RIS captures the entire original document and converts it to a series of raster scan lines and measures a set of primary color densities, i.e. red, green and blue densities, at each point of the original document. This information is transmitted to an image processing system (IPS), indicated generally by the reference numeral 12. IPS 12 contains control electronics which prepare and manage the image data flow to a raster output scanner (ROS), indicated generally by the reference numeral 16. A user interface (UI), indicated generally by the reference numeral 14, is in communication with IPS 12. UI 14 enables an operator to control the various operator adjustable functions. The output signal from UI 14 is transmitted to IPS 12. A signal corresponding to the desired image is transmitted from IPS 12 to ROS 16, which creates the output copy image. ROS 16 lays out the image in a series of horizontal scan lines with each line having a specified number of pixels per inch. ROS 16 includes a laser having a rotating polygon mirror block associated therewith. ROS 16 exposes a charged photoconductive belt 20 of a printer including a marking engine, indicated generally by the reference numeral 18, to achieve a set of subtractive primary latent images. The latent images are developed with cyan, magenta, and yellow developer material, respectively. These developed images are transferred to a copy sheet in superimposed registration with one another to form a multicolored image on the copy sheet. This multi-colored image is then fused to the copy sheet forming a color copy. Alternatively, the superimposed images may be deposited on a transparent substrate of the type utilized for the optical projection of images.

With continued reference to FIG. 2, printer or marking engine 18 is an electrophotographic printing machine. Photoconductive belt 20 of marking engine 18 is preferably made from a polychromatic photoconductive material. The photoconductive belt moves in the direction of arrow 22 to advance successive portions of the photoconductive surface sequentially through the various xerographic processing stations disposed about the path of movement thereof.

Photoconductive belt 20 is entrained about transfer rollers 24 and 26, tensioning roller 28, and drive roller 30. Drive roller 30 is rotated by a motor 32 coupled thereto by suitable means such as a belt drive, not shown. As roller 30 rotates, it advances belt 20 in the direction of arrow 22.

Initially, a portion of photoconductive belt 20 passes through a charging station, indicated generally by the reference numeral 33. At charging station 33, a corona generating device 34 charges photoconductive belt 20 to a relatively high, substantially uniform electrostatic potential.

Next, the charged photoconductive surface is moved through an exposure station, indicated generally by the reference numeral 35. Exposure station 35 receives a modulated light beam corresponding to information derived by RIS 10 having a multi-colored original document 38 positioned thereat. RIS 10 captures the entire image from the original document 38 and converts it to a series of raster scan lines which are transmitted as electrical signals to IPS 12. The electrical signals from RIS 10 correspond to the red, green and blue densities at each point in the original document. IPS 12 converts the set of red, green and blue density signals, i.e. the set of signals corresponding to the primary color densities of original document 38, to a set of calorimetric coordinates. The operator actuates the appropriate keys of UI 14 to adjust the parameters of the copy. UI 14 may be a touch screen, or any other suitable control panel, providing an operator interface with the system. The output signals from UI 14 are transmitted to IPS 12. The IPS then transmits signals corresponding to the desired image to ROS 16. ROS 16 includes a laser with rotating polygon mirror blocks. Preferably, a nine facet polygon is used. ROS 16 illuminates, via mirror 37, the charged portion of photoconductive belt 20 at a rate of about 400 pixels per inch. The ROS will expose the photoconductive belt to record three latent images. One latent image is developed with cyan developer material. Another latent image is developed with magenta developer material and the third latent image is developed with yellow developer material. The latent images formed by ROS 16 on the photoconductive belt correspond to the signals transmitted from IPS 12.

After the electrostatic latent images have been recorded on photoconductive belt 20, the belt advances such latent images to a development station, indicated generally by the reference numeral 39. The development station includes four individual developer units indicated by reference numerals 40, 42, 44 and 46. The developer units are of a type generally referred to in the art as "magnetic brush development units." Typically, a magnetic brush development system employs a magnetizable developer material including magnetic carrier granules having toner particles adhering triboelectrically thereto. The developer material is continually brought through a directional flux field to form a brush of developer material. The developer material is constantly moving so as to continually provide the brush with fresh developer material. Development is achieved by bringing the brush of developer material into contact with the photoconductive surface. Developer units 40, 42, and 44, respectively, apply toner particles of a specific color which corresponds to the compliment of the specific color separated electrostatic latent image recorded on the photoconductive surface. The color of each of the toner particles is adapted to absorb light within a preselected spectral region of the electromagnetic wave spectrum. For example, an electrostatic latent image formed by discharging the portions of charge on the photoconductive belt corresponding to the green regions of the original document will record the red and blue portions as areas of relatively high charge density on photoconductive belt 20, while the green areas will be reduced to a voltage level ineffective for development. The charged areas are then made visible by having developer unit 40 apply green absorbing toner particles onto the electrostatic latent image recorded on photoconductive belt 20. Similarly, a blue separation is developed by developer unit 42 with blue absorbing toner particles, while the red separation is developed by developer unit 44 with red absorbing toner particles. Developer unit 46 contains black toner particles and may be used to develop the electrostatic latent image formed from a black and white original document. Each of the developer units is moved into and out of an operative position. In the operative position, the magnetic brush is closely adjacent the photoconductive belt, while in the non-operative position, the magnetic brush is spaced therefrom. In FIG. 2, developer unit 40 is shown in the operative position with developer units 42, 44 and 46 being in the non-operative position. During development of each electrostatic latent image, only one developer unit is in the operative position, the remaining developer units are in the non-operative position. This insures that each electrostatic latent image is developed with toner particles of the appropriate color without commingling.

After development, the toner image is moved to a transfer station, indicated generally by the reference numeral 65. Transfer station 65 includes a transfer zone, generally indicated by reference numeral 64. In transfer zone 64, the toner image is transferred to a sheet of support material, such as plain paper amongst others. At transfer station 65, a sheet transport apparatus, indicated generally by the reference numeral 48, moves the sheet into contact with photoconductive belt 20. Sheet transport 48 has a pair of spaced belts 54 entrained about a pair of substantially cylindrical rollers 50 and 52. A sheet gripper (not shown) extends between belts 54 and moves in unison therewith. A sheet 25 is advanced from a stack of sheets 56 disposed on a tray. A friction retard feeder 58 advances the uppermost sheet from stack 56 onto a pre-transfer transport 60. Transport 60 advances sheet 25 to sheet transport 48. Sheet 25 is advanced by transport 60 in synchronism with the movement of sheet gripper 84. In this way, the leading edge of sheet 25 arrives at a preselected position, i.e. a loading zone, to be received by the open sheet gripper. The sheet gripper then closes securing sheet 25 thereto for movement therewith in a recirculating path. The leading edge of sheet 25 is secured releasably by the sheet gripper. As belts 54 move in the direction of arrow 62, the sheet moves into contact with the photoconductive belt, in synchronism with the toner image developed thereon. At transfer zone 64, a corona generating device 66 sprays ions onto the backside of the sheet so as to charge the sheet to the proper electrostatic voltage magnitude and polarity for attracting the toner image from photoconductive belt 20 thereto. The sheet remains secured to the sheet gripper so as to move in a recirculating path for three cycles. In this way, three different color toner images are transferred to the sheet in superimposed registration with one another. One skilled in the art will appreciate that the sheet may move in a recirculating path for four cycles when under color black removal is used and up to eight cycles when the information on two original documents is being merged onto a single copy sheet. Each of the electrostatic latent images recorded on the photoconductive surface is developed with the appropriately colored toner and transferred, in superimposed registration with one another, to the sheet to form the multi-color copy of the colored original document.

After the last transfer operation, the sheet gripper opens and releases the sheet. A conveyor 68 transports the sheet, in the direction of arrow 70, to a fusing station, indicated generally by the reference numeral 71, where the transferred toner image is permanently fused to the sheet.

The fusing station includes a heated fuser roll 72 and a pressure roll 74. The sheet passes through the nip defined by fuser roll 72 and pressure roll 74. The toner image contacts fuser roll 72 so as to be affixed to the sheet. Thereafter, the sheet is advanced by a pair of rolls 76 to catch tray 78 for subsequent removal therefrom by the machine operator.

The last processing station in the direction of movement of belt 20, as indicated by arrow 22, is a cleaning station, indicated generally by the reference numeral 79. A rotatably mounted fibrous brush 80 is positioned in the cleaning station and maintained in contact with photoconductive belt 20 to remove residual toner particles remaining after the transfer operation. Thereafter, lamp 82 illuminates photoconductive belt 20 to remove any residual charge remaining thereon prior to the start of the next successive cycle.

Figure 1:
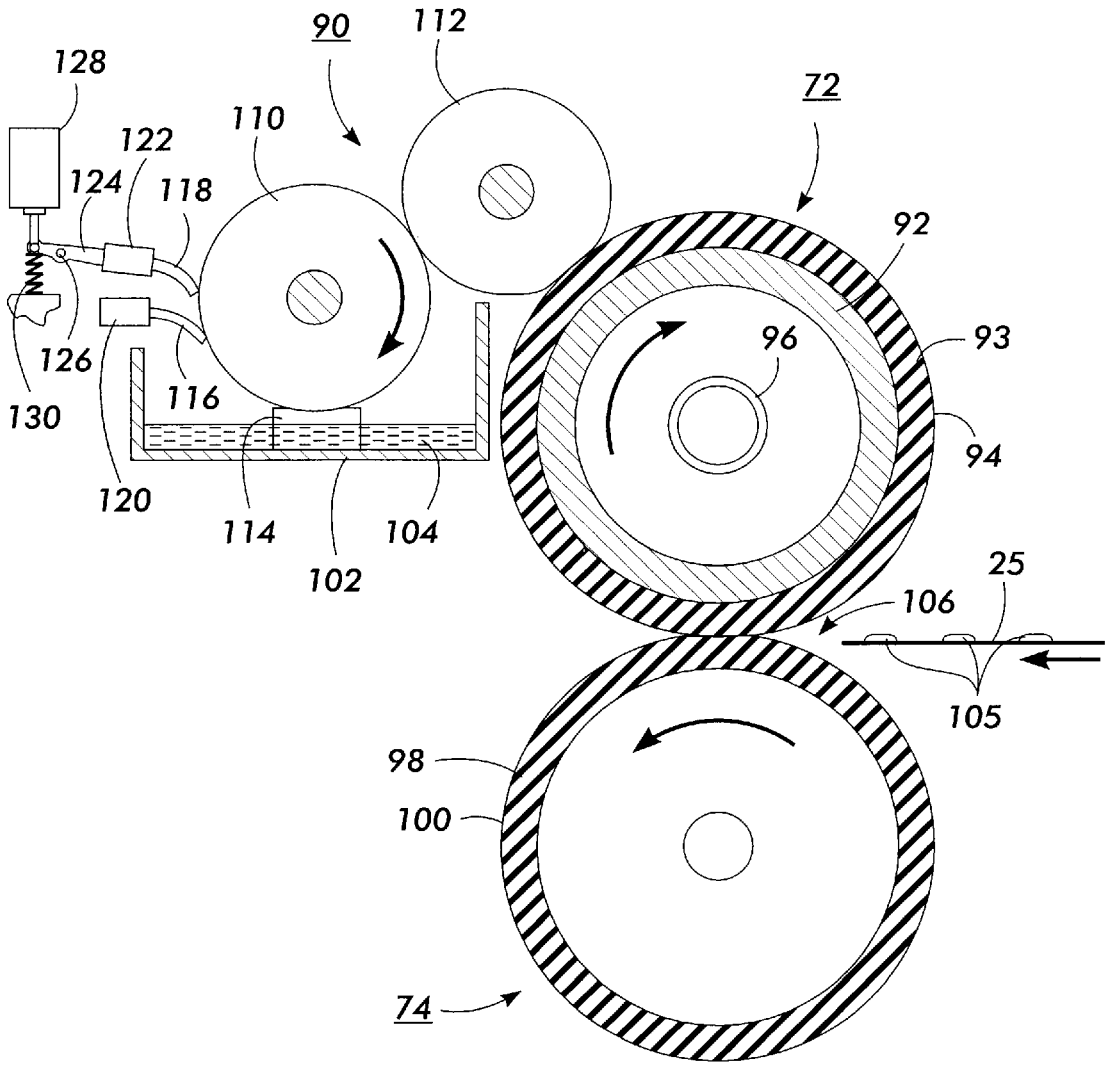
FIG. 1 is a schematic representation of a heat and pressure fuser and RAM system therefor.

Attention is now directed to FIG. 1 wherein a heat and pressure fuser located at fusing station 71 is illustrated together with the Release Agent Management (RAM) system 90.

As shown in FIG. 1, the fuser apparatus comprises the heated fuser roll 72 which is composed of a core 92 having thereon a relatively thick layer 93 of thermally conductive silicone rubber over coated with a relatively thin layer 94 of Viton Registered TM. The core 92 may be made of various metals such as copper, iron, aluminum, nickel, stainless steel, etc. and various synthetic resins. Aluminum is preferred as the material for the core 92, although this is not critical. The core 92 is hollow and a heating element 96 is generally positioned inside the hollow core to supply the heat for the fusing operation. Heating elements suitable for this purpose are known in the prior art and may comprise an infrared heater made of a quartz envelope having a tungsten resistance heating element disposed internally thereof. The method of providing the necessary heat is not critical to the present invention, and the fuser member can be heated by internal means, external means or a combination of both. Heating means are well known in the art for providing sufficient heat to fuse the toner to the support. The fusing elastomer layer may be made of any of the well known materials such as the Viton and/or silicone rubber.

The fuser roll 72 is shown in a pressure contact arrangement with the backup or pressure roll 74. The pressure roll 74 comprises a metal core 98 with an outer layer 100 of a heat-resistant material. In this assembly, both the fuser roll 73 and the pressure roll 74 are mounted on bearings (not shown) which are biased so that the fuser roll 72 and pressure roll 74 are pressed against each other under sufficient pressure to form a nip 106. It is in this nip that the fusing or fixing action takes place. The layer 100 may be made of any of the well known materials such as Teflon a trademark of E.I. duPont.

The RAM system 90 comprises sump 102 containing a quantity of release agent material such as silicone oil 104. The image receiving member or final support 25 having toner images thereon is moved through a nip 106 (FIG. 1) with the toner images contacting the heated fuser roll 72. The toner material forming the image is prevented from offsetting to the surface of the fuser roll 72 through the application of silicone oil 104 contained in sump 102.

The RAM system 90 further comprises a metering roll 110 and a donor roll 112. The metering roll is supported partially immersed in the silicone oil 104 and contacts the donor roll for conveying silicone oil from the sump to the surface of the donor roll 112. The metering roll also contacts a pad 114 which is immersed in the silicone oil. The pad or wick serves to provide an air seal which disturbs the air layer formed at the surface of the metering roll during rotation thereof. In the absence of the pad, the air layer would be coextensive with the surface of the metering roll thereby precluding contact between the metering roll and the release agent.

The donor roll is rotatably supported in contact with the metering roll and also in contact with the fuser roll 72. Rotation of the donor roll is effected through frictional engagement with the fuser roll 72 and rotational movement of the metering roll 110 is effected through engagement with the donor roll 112. While the donor roll is illustrated as contacting the fuser roll, it will be appreciated that, alternately, it may contact the pressure roll 74. Also, the positions of the fuser and pressure rolls may be reversed for use in other copiers or printers. A pair of metering blades 116 and 118 supported in contact with the metering roll 110 serve to meter silicone oil to the required thickness on the metering roll.

The metering blades 116 and 118 function in a doctoring fashion to meter the silicone oil onto the surface of the fuser roll. The blade members are fabricated from an elastomeric material such as silicone rubber or Viton™ in accordance with well known manufacturing techniques. The blade 116 is supported for continuous contact with the metering roll while the blade 118 is supported for selective engagement with the surface of the metering roll. The blade 116 is captivated in a holder 120 which is supported in a conventional manner, not shown. A blade holder 122 for the blade 118, on the other hand, is supported for pivotal movement by an arm 124. To this end, arm 124 is supported by a pivot member 126. A solenoid actuated pull member 128 serves to pivot the arm and blade 118 such that it engages the metering roll during one of two modes of operation. During the other mode of operation, a spring 130 serves to pivot the arm in the opposite direction for effecting disengagement of the blade 118 from the metering roll.

The blade 116, during the one mode of operation, meters excess oil back into the sump, leaving only a predetermined quantity of oil that is necessary for optimal fusing process life when fusing color toner images on a substrate such as plain paper. The blade 118 which is positioned after the blade 116 serves to further reduce the amount of oil on the metering roll. The blade 118 engages the metering roll only when color toner images are to be fixed to certain substrates that require a smaller quantity of oil such as a transparent substrate. The blade 116 has an edge radius dimension that is in a range equal to about 0.00 to 0.012 inch and the blade 118 has an edge radius dimension that is in a range equal to about 0.005 inch. Preferably, the blade 116 has a radius equal to about 0.007 inch while the radius of the blade edge of the blade 118 contacting the metering roll is equal to about 0.002 inch. With a edge radius of about 0.007, the blade 116 will meter approximately 7 $\mu$l of silicone per imaged substrate oil while the blade 118 with an edge radius of about 0.002 inch will reduce that amount to 2 $\mu$l per substrate.

The two modes of operation, therefore, the one where color images are fixed on plain paper and the other one where color images are fixed on transparencies are programmable using the UI 14. Thus, by way of example, when plain paper is used the mode of operation selected through the UI causes the blade 118 to be disengaged from the metering roll. When substrates such a transparencies of Mylar™ are used the mode of operation selected through the UI causes blade 118 to engage the metering roll for further reducing the amount of oil beyond the reduction effected by the blade 116.

We claim:

1. A release agent management structure, said structure comprising:

a rotatable donor member;

a supply of release agent material;

a metering member supported for rotation in contact with said donor member and said supply of release agent material;

a pair of metering blade structures, one of said pair of blade structures being supported in continuous contact with the metering member, and the other of said pair of blade structures being selectively movable into and out of contact with the metering member; and means for preventing contact of said selectively movable one of said pair of blade structures with said metering member in a first mode of operation and means for effecting contact of said selectively movable one of said pair of blade structures during a second mode of operation.

2. A release agent management structure according to claim 1 wherein said blade structures comprise a pair of blades each having a different edge radius for reducing the amount of release agent material on said metering member to different levels.

3. A release agent management structure according to claim 2 wherein one of said pair of blades has a larger edge radius than the other blade of said pair of blades.

4. A release agent management structure according to claim 3 wherein said blade which is in continuous contact with the metering member has the larger edge radius and contacts release agent material on said metering member before it is contacted by the selectively movable blade having a smaller edge radius.

5. A release agent management structure according to claim 4 wherein said metering member comprises a metering roll.

6. A release agent management structure according to claim 5 wherein said release agent material comprises silicone oil.

7. A heat and pressure fuser having a release agent management structure, said fuser comprising:

a rotatable heated fuser member;

a rotatable pressure member supported for pressure contact with said heated fuser member;

a rotatable donor member supported for contact with one of said fuser and pressure members;

a supply of release agent material;

a metering member supported for rotation in contact with said donor member and supply of release agent material;

a pair of metering blade structures, one of said pair of blade structures being supported in continuous contact with the metering member, and the other of said pair of blade structures being selectively movable into and out of contact with the metering member; and means for preventing contact of said selectively movable one of said pair of blade structures with said metering member in a first mode of operation and means for effecting contact of said selectively movable one of said pair of blade structures during a second mode of operation.

8. A heat and pressure fuser according to claim 7 wherein said blade structures comprise a pair of blades each having a different edge radius for reducing the amount of release agent material on said metering member to different levels.

9. A heat and pressure fuser according to claim 8 wherein one of said pair of blades has a larger edge radius than the other blade of said pair of blades.

10. A heat and pressure fuser according to claim 9 wherein said blade which is in continuous contact with the metering member has the larger edge radius and contacts release agent material on said metering member before it is contacted by the selectively movable blade having a smaller edge radius.

11. A heat and pressure fuser according to claim 10 wherein said metering member comprises a metering roll.

12. A heat and pressure fuser according to claim 11 wherein said release agent material comprises silicone oil.

13. A method of metering release agent material on a metering member of a release agent management structure, said method including the steps of:

supporting a metering member for rotation in contact with a rotatable donor member and a supply of release agent material;

providing a pair of metering blade structures, one of said pair of blade structures being supported in continuous contact with the metering member, and the other of said pair of blade structures being selectively movable into and out of contact with the metering member;

preventing contact of the selectively movable metering blade structure with said metering member in a first mode of operation and effecting contact of the selectively movable metering blade structure during a second mode of operation.

14. The method according to claim 13 wherein said blade structures comprise a pair of blades having different edge radiuses for reducing the amount of release agent material on said metering member to different levels.

15. The method according to claim 14 wherein one of said pair of blades has a larger edge radius than the other blade of said pair of blades.

16. The method according to claim 15 wherein said blade which is in continuous contact with the metering member has the larger edge radius and contacts release agent material on said metering member before it is contacted by the selectively movable blade having a smaller edge radius.

17. The method according to claim 16 wherein said metering member comprises a metering roll; and wherein said release agent material comprises silicone oil.

* * * * *